US006135218A

United States Patent [19]

Deane et al.

[11] Patent Number: 6,135,218

[45] **Date of Patent: *Oct. 24, 2000**

[54] FIXED CUTTER DRILL BITS WITH THIN, INTEGRALLY FORMED WEAR AND EROSION RESISTANT SURFACES

[75] Inventors: John D. Deane, Spring; Douglas B. Caraway, Kingwood, both of Tex.

[73] Assignee: Camco International Inc., Houston, Tex.

[ * ] Notice: This patent is subject to a terminal disclaimer.

[21] Appl. No.: 09/265,266

[22] Filed: Mar. 9, 1999

[51] Int. Cl.[7] ..... E21B 10/46; E21B 10/60

[52] U.S. Cl. ..... 175/425; 175/340; 175/374; 175/393; 175/424; 76/108.2

[58] Field of Search ..... 175/340, 374, 175/393, 424, 425, 428, 429, 430, 431, 432; 76/108.2

[56] References Cited

U.S. PATENT DOCUMENTS

| | | | |
|---|---|---|---|
| 2,371,489 | 3/1945 | Williams, Jr. . | |
| 4,073,354 | 2/1978 | Rowley et al. . | |
| 4,303,136 | 12/1981 | Ball . | |
| 4,396,077 | 8/1983 | Radtke . | |
| 4,452,324 | 6/1984 | Jurgens . | |
| 4,499,795 | 2/1985 | Radtke . | |
| 4,515,227 | 5/1985 | Cerkovnik | 175/393 X |
| 4,539,175 | 9/1985 | Lichti et al. . | |
| 4,554,130 | 11/1985 | Ecer . | |
| 4,562,892 | 1/1986 | Ecer . | |
| 4,630,692 | 12/1986 | Ecer . | |
| 4,733,734 | 3/1988 | Bardin et al. | 175/393 X |
| 4,753,305 | 6/1988 | Fisher | 175/428 |
| 4,794,994 | 1/1989 | Deane et al. . | |
| 4,830,123 | 5/1989 | Daly et al. | 175/431 |
| 4,844,185 | 7/1989 | Newton, Jr. et al. | 76/108.2 X |
| 4,848,489 | 7/1989 | Deane . | |
| 4,856,311 | 8/1989 | Conaway . | |
| 4,883,136 | 11/1989 | Trujillo . | |
| 4,907,662 | 3/1990 | Deane et al. . | |
| 4,942,750 | 7/1990 | Conaway . | |
| 4,949,598 | 8/1990 | Griffin . | |
| 5,032,352 | 7/1991 | Meeks et al. . | |
| 5,096,005 | 3/1992 | Ivie et al. | 175/340 |
| 5,110,542 | 5/1992 | Conaway . | |
| 5,561,834 | 10/1996 | Score . | |
| 5,653,299 | 8/1997 | Sreshta et al. . | |
| 5,816,090 | 10/1998 | Hodge et al. . | |
| 5,967,248 | 10/1999 | Drake et al. . | |
| 6,006,846 | 12/1999 | Tibbits et al. | 175/428 |
| 6,045,750 | 4/2000 | Drake et al. | 419/6 |

*Primary Examiner*—Eileen D. Lillis
*Assistant Examiner*—Jong-Suk Lee
*Attorney, Agent, or Firm*—Jeffery E. Daly

[57] ABSTRACT

A fixed-cutter drill bit for boring through earth has a body made predominately of high strength steel with thin erosion and abrasion resistant surfaces integrally formed in the steel in areas likely to encounter abrasive or erosive conditions. The drill bit may be formed by a rapid solid state densification (RSSDPM) process. The drill bit combines the high strength of conventional steel bits with design freedom and hardness equal to or greater than conventional matrix bits. Due to the manner in which the hard particles, such as tungsten carbide, are integrally held in a steel matrix, aggressive fluid hydraulics may be employed with the drill bit without unduly limiting the performance of the drill bit.

16 Claims, 3 Drawing Sheets

FIXED CUTTER DRILL BITS WITH THIN, INTEGRALLY FORMED WEAR AND EROSION RESISTANT SURFACES

BACKGROUND OF THE INVENTION

1. Field of the Invention

The present invention relates generally to fixed cutter earth boring drill bits and, more particularly, to PDC type drill bits having novel integrally formed wear and erosion resistant surfaces.

2. Description of the Related Art

There are two basic types of earth boring drill bits commonly used to form the boreholes in the earth for mineral exploration and recovery. The first utilizes one or more rolling cutters mounted upon a bit body. There are typically several rows of cutting teeth on each cutter. When the bit body is rotated and weight is applied, the teeth on the cutters engage the earth causing the cutters to rotate. As the cutters rotate, the teeth are sequentially pushed into the earth effecting a drilling action. These bits are commonly known as rolling cutter drill bits or rock bits.

The second type of earth boring bit, and the subject of the present invention, utilizes cutting elements fixed upon the body of the bit. These bits are also rotated, and when weight is applied, the cutting elements are pushed into, and dragged through the earth. This dragging action causes earth removal by shearing.

There are different fixed cutter bit designs for different drilling applications. For example, a high bladed steel bit (often called a fishtail bit) may be suitable for rapidly drilling through very soft soils and formations, while a polycrystalline diamond compact (PDC) bit may be used to drill through harder rock formations. For very hard and tough rock formations, infiltrated tungsten-carbide matrix bits with natural diamond cutting elements are used. These are typically called diamond or natural diamond bits.

As a general rule, bits that are able to drill rapidly through soft formations cannot penetrate the harder formations and, similarly, bits that are able to drill through harder formations are not aggressive enough to economically drill through softer formations. Thus, when drilling deep wells through many different types of rock and soil, bits may have to be changed many times in response to wear or in response to changing soil conditions.

Common to all types of earth drilling bits is a means to flush the drilled earth away from the cutting interface and transport it to the surface. For shallow boreholes, air is a suitable flushing fluid. However, for the deep boreholes commonly drilled for the exploration and production of oil and gas, the flushing fluid is typically a liquid. Because of its color and consistency, this liquid has come to be known as drilling mud. Although the type of drilling fluid may vary, it typically the contains abrasive elements, and it is usually pumped through nozzle orifices on the drill bit, typically at a rate of about 250 to 500 feet per second.

In rolling cutter drill bits the primary role of drilling mud is to clean the bottom of the boreholes and transport the cuttings to the surface. In fixed cutter drill bits with diamond cutting elements, however, the drilling mud has the added critical role of cooling the diamonds. Clearly, diamond, and other suitable forms of superhard materials, are much harder than the earth formations being drilled, so theoretically these materials should not exhibit any wear. However, it is also apparent from examination of used bits that the superhard cutting elements do degrade. It was found that the degradation of the superhard cutting elements was caused, at least in part, by the high temperatures generated at the cutting face from the friction of scraping the rock. In order to minimize the degradation of the cutting faces, they must be cooled. For maximum cooling (and therefore minimum degradation), it is desirable to have the drilling fluid impinge directly on the cutting elements. However, PDC bits generally have exposed steel or infiltrated matrix surfaces adjacent to the diamond cutting elements, which can rapidly erode in the high velocity, abrasive laden stream of drilling fluid. There are numerous patents which show high velocity drilling fluids directed upon superhard cutting elements in steel bodied PDC bits, as shown, for instance, in U.S. Pat. Nos. 4,484,489; 4,907,662; 4,974,994; 4,883,136; 4,452,324; 4,303,136 as well as many others. Unfortunately, it is not possible to direct the flow in this manner without causing severe erosion of the surface adjacent to the cutting elements.

For this reason, the nozzle orifices on PDC drill bits are oriented such that high velocity drilling fluid does not directly impinge the diamond cutting elements. Thus, although directing the drilling fluid at the diamond cutting elements on PDC bits would provide better cooling and longer life, commercial drill bits do not incorporate this feature because of erosion. Instead, the nozzle orifices typically direct the drilling fluid toward the formation at the bottom of the hole, and the splash is used to clean and cool the superhard cutting elements. As a consequence, typical PDC bits do not perform well where very high cutting element face friction is present, such as in hard rock drilling.

In addition, where soft, sticky formations are encountered, such as shales with high clay content, the hydraulic action of conventional PDC bits is sometimes inadequate to clean the cuttings away from the bit body and cutters resulting in a phenomenon known as bit balling. Most drilling applications allow for between 100 hydraulic horsepower (HHP) and as much as 800 HHP at the bit. Optimizing the use of this significant source of energy to clean and cool the bits requires proper orifice size selection and proper placement of the nozzles, including optimum orientation.

In the past, there have been many different attempts to address the erosion problem described above. The tried and true method to obtain erosion resistance is to apply welded hardmetal in thick layers to the surface of the cutting face. This is the most common form of wear resistant material in use today for steel bodied PDC bits. Unfortunately, welded hardmetal can crack as the blades of the PDC bit bend in response to the drilling loads. Once a crack starts, the impinging drilling fluid quickly erodes the exposed, soft underlying steel layer. Applying welded hardmetal is typically a hand applied process and it is difficult to apply to the sides and bottom of the channels on the cutting face of PDC bits. Because it is a manual process, it is also subject to variation based on human and environmental factors. Once the welded hardmetal is applied, it is generally so thick and uneven that it affects the hydraulic flow of the flushing fluids. The swirls and flow eddies in the wake of these thick, rough layers can make the erosion problem even worse. Finally, the temperature caused by the welding process not only affects the heat treatment of the steel PDC bit bodies, it can also cause the bodies to warp and even crack due to the thermal stresses and can have a deleterious effect on the diamonds themselves.

Another approach to erosion resistance is shown by Radtke in U.S. Pat. No. 4,396,077, herein incorporated by reference. Radtke describes a thick tungsten carbide coating applied to the cutting faces of PDC bit bodies with a high velocity plasma arc flame spray process. This process was considered an improvement over the conventional high velocity flame spray processes known at the time. Unfortunately, the problem with this and all other flame spray type coating processes is that the sprayed particle stream must impinge nearly perpendicular to the surface to be coated to make the coating adhere to the cutting face of the bit body. Although sprayed coatings can provide good erosion protection on some areas of the bit, the coating does not adhere well to the vertical surfaces normal to the cutting face. PDC bits usually have channels formed in the cutting face for the high velocity flushing fluid. Since these channels usually have vertical walls, spray type coatings to not provide adequate erosion resistance in these areas of the bit. Also, the discharge nozzle on the flame spray apparatus is generally located some distance away from the surface being coated. The irregular features on the cutting faces of most PDC bits cause 'shadows' which block the spray path, preventing direct impingement by the spray. These limitations greatly reduce the effectiveness of the flame spray processes for producing wear and erosion resistant coatings on PDC bits.

Natural diamond bits (also called diamond bits) are very old in the drilling industry and provide an alternate way of addressing the wear and erosion problems of fixed cutter drill bits. This type of fixed cutter drill bit is made in an infiltration process. In this process, natural diamonds or other very hard fixed cutting elements are inserted onto cavities in a mold. Powders of highly wear and erosion resistant materials (typically including tungsten carbide) are then packed into the mold, and an infiltrate, typically a copper alloy, is placed in contact with the powders. The mold with the powders, cutting elements, and infiltrate are all placed into a furnace and heated to the melting point of the infiltrate. The melted infiltrate fuses the diamonds and powders into a solid mass. This process produces a unitary body of infiltrated tungsten carbide and fixed cutting elements with improved wear and erosion resistance. By way of example, an early diamond bit design is disclosed in U.S. Pat. No. 2,371,489.

It is also possible to form pockets in an infiltrated cutting face and later attach polycrystalline diamond cutters, as shown in U.S. Pat. No. 4,073,354, providing a somewhat more aggressive cutting structure than traditional diamond bits.

Unfortunately, infiltrated bits are expensive to manufacture. Each bit must be cast in a mold in a very labor intensive process.

Infiltrated bit structures are also weak in bending, so the blade height achievable with an infiltrated product is limited by the intrinsic strength of the material in bending. Therefore, these relatively shorter blades do not penetrate the earth as aggressively as the extended cutting faces of steel PDC bits. As a result, infiltrated bits do not provide the very high (and desirable) rates of penetration of PDC bits.

Finally, because the infiltrated products use a relatively soft copper based infiltrate to bind the tungsten carbide together, the infiltrated product can also be subject to erosion as the fluid stream attacks the copper binder, weakening the matrix and allowing tungsten carbide to be loosened from the body. The infiltrated design provides some erosion improvement over steel, but is still subject to all the limitations described above.

There are also numerous bit designs which are derivatives of either the infiltrated bit process or the coated steel process used in PDC bits. For example, in U.S. Pat. Nos. 4,554,130; 4,562,892; and 4,630,692, all herein incorporated by reference, a cladding process is disclosed for making a PDC type bit with a layer of wear and erosion resistant material. In these patents, a steel blank is coated with a thick layer of powders, the assembly is heated and then transferred to a press where the powders are fused to the steel surface under temperature and pressure with the aid of a ceramic or graphite pressure transfer medium. The layer must be thick, for it must contain a binder along with the wear resistant powder as it is compressed in the press. Although PDC type bits are shown and described in these patents, it is impractical to clad the vertical surfaces as shown. This is because the movement of the pressure transfer media tends to scrape the powders from the vertical steel surface as the press closes. Also, because the steel body itself is incompressible, the pressure transfer media will not be able to move in a manner which allows for an even pressure distribution.

The end product of the above described cladding process has many of the same deficiencies as the flame spray coatings previously described, in that the vertical surfaces will not have adequate erosion protection.

Another derivative process that is similar to infiltration is disclosed in U.S. Pat. No. 4,499,795. This patent describes a bit formed by a molten steel casting process wherein a tungsten carbide powder coating is applied to the walls of the casting mold and molten steel poured in. The patent does not disclose how the tungsten carbide is able to retain its wear resistant properties after a prolonged time at the temperature of molten steel. Similarly, it is not disclosed how the powders stay adhered to the walls of the mold as the very turbulent flow of steel is introduced. Nor does the patent disclose how to prevent excessive surface cracking of the coating as it shrinks and cools. The problematic nature of this process is the likely reason that it is not in commercial use today.

In summary, it would be desirable to have a fixed cutter drill bit with superhard cutting elements that can drill the soft formations of the earth at high drilling rates of penetration, and at the same time drill the hard intermingled layers of earth formations without significant cutter degradation. There are also many drilling applications where it would be desirable to have the aggressive behavior of a high-bladed steel bit coupled with the erosion and abrasion resistance of a matrix body bit. Furthermore, it would be desirable to provide a fixed cutter drill bit having an overlay that exhibits erosion resistant qualities superior to those of traditional hard faced steel drill bits while maintaining the strength and toughness of a steel body. This greater erosion resistance would permit more aggressive fluid hydraulics in which fluid nozzle orifices could be aimed directly at the blades to facilitate cooling of the diamond or other superhard material layer and enhance removal of the drilled cuttings without reducing the life of the drill bit below a commercially acceptable level.

SUMMARY OF THE INVENTION

In accordance with one aspect of the present invention, there is provided a fixed cutter earth boring bit having a bit body with upper and lower ends. The upper end of the bit body is adapted to be secured to a drilling string. A cutting face is formed on the lower end of the bit body, and there is passaging within the bit body to receive pressurized drilling fluid from the drilling string. An orifice mounted on the cutting face is in fluid communication with the passaging in the bit body to receive the pressurized drilling fluid, and is adapted to accelerate the pressurized drilling fluid. A superhard cutting element is fixed upon the cutting face to engage the earth and effect a drilling action. A thin layer of erosion resistant material is integrally formed with the cutting face. The accelerated drilling fluid impinges directly upon the cutting element and the thin layer of erosion resistant material.

In accordance with another aspect of the present invention, there is provided a fixed cutter earth boring bit comprising a steel bit body with upper and lower ends. The upper end of the bit body is adapted to be secured to a drilling string and a cutting face is formed on the lower end of the bit body. There is passaging within the bit body to receive pressurized drilling fluid from the drilling string. An orifice on the cutting face is in fluid communication with the passaging in the bit body to receive the pressurized drilling fluid, and is adapted to accelerate the pressurized drilling fluid. A superhard cutting element is fixed upon the cutting face to engage the earth and effect a drilling action. There is an erosion and abrasion resistant overlay on a portion of the cutting face. The overlay has a hard material particulate containing a metal carbide and an alloy steel matrix. The volume fraction of the hard material particulate in the overlay is greater than about 75%, the average particle size of the hard material particulate is between about 40 mesh and about 80 mesh, and the thickness of the overlay is less than about 0.050 inches.

In accordance with still another aspect of the present invention, there is provided an earth boring bit comprising a fixed cutter and a surface formed with an erosion and abrasion resistant overlay. The overlay comprises a hard material particulate containing a metal carbide and an alloy steel matrix. The volume fraction of the hard material particulate in the overlay is greater than about 75%, the average particle size of the hard material particulate is between about 40 mesh and about 80 mesh, and the thickness of the overlay is less than about 0.050 inches. A high velocity drilling fluid impinges upon the overlay and the fixed cutter.

BRIEF DESCRIPTION OF THE DRAWINGS

The foregoing and other advantages of the invention will become apparent upon reading the following detailed description and upon reference to the drawings in which.

DESCRIPTION THE PREFERRED EMBODIMENT

Figure 1:
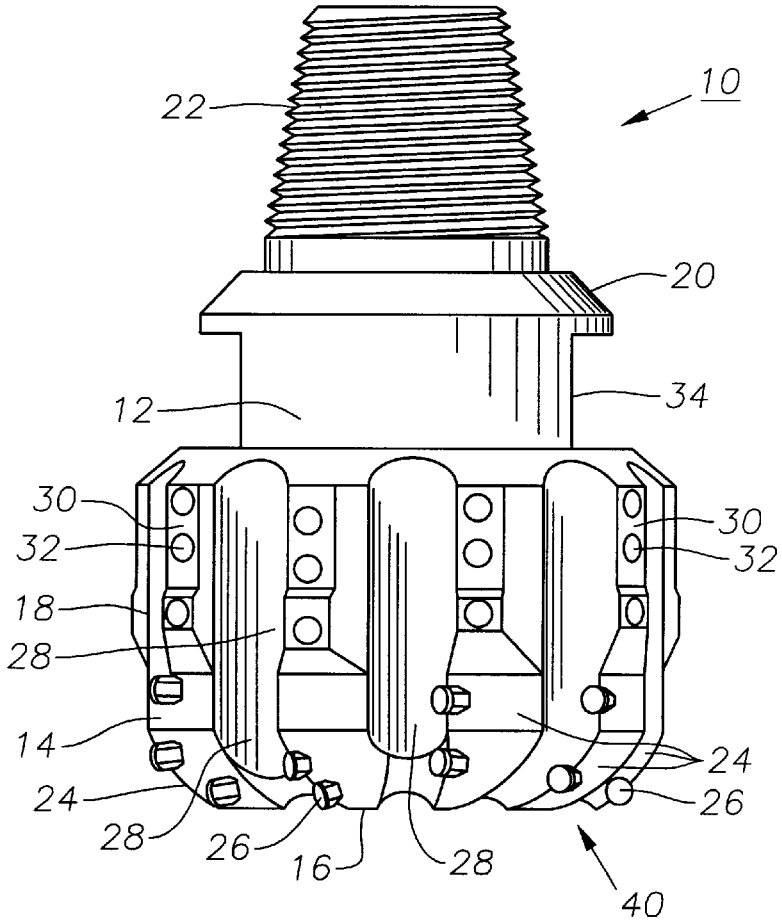
FIG. 1 is a perspective view of a drag-type earth boring bit of the present invention.
Figure 2:
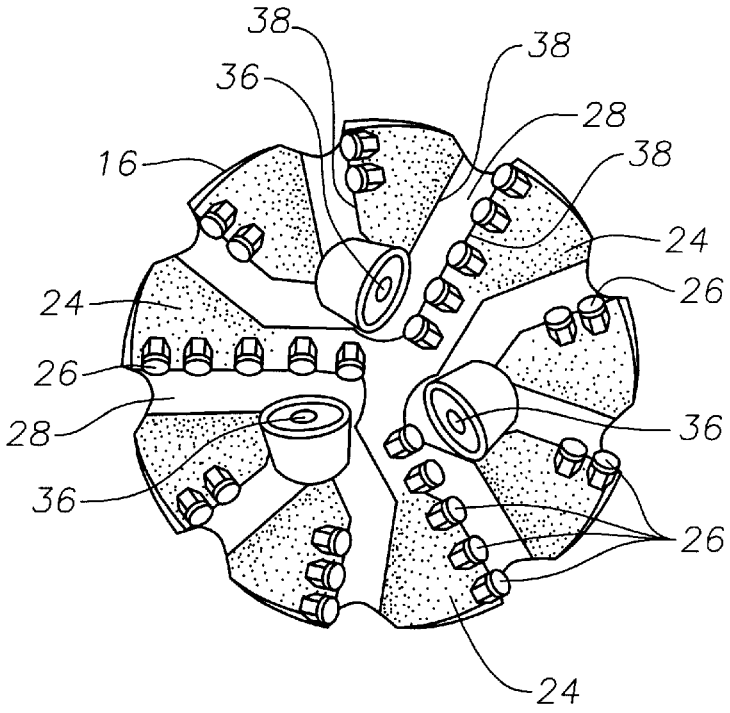
FIG. 2 illustrates a bottom view of the drill bit of FIG. 1.
Figure 6:
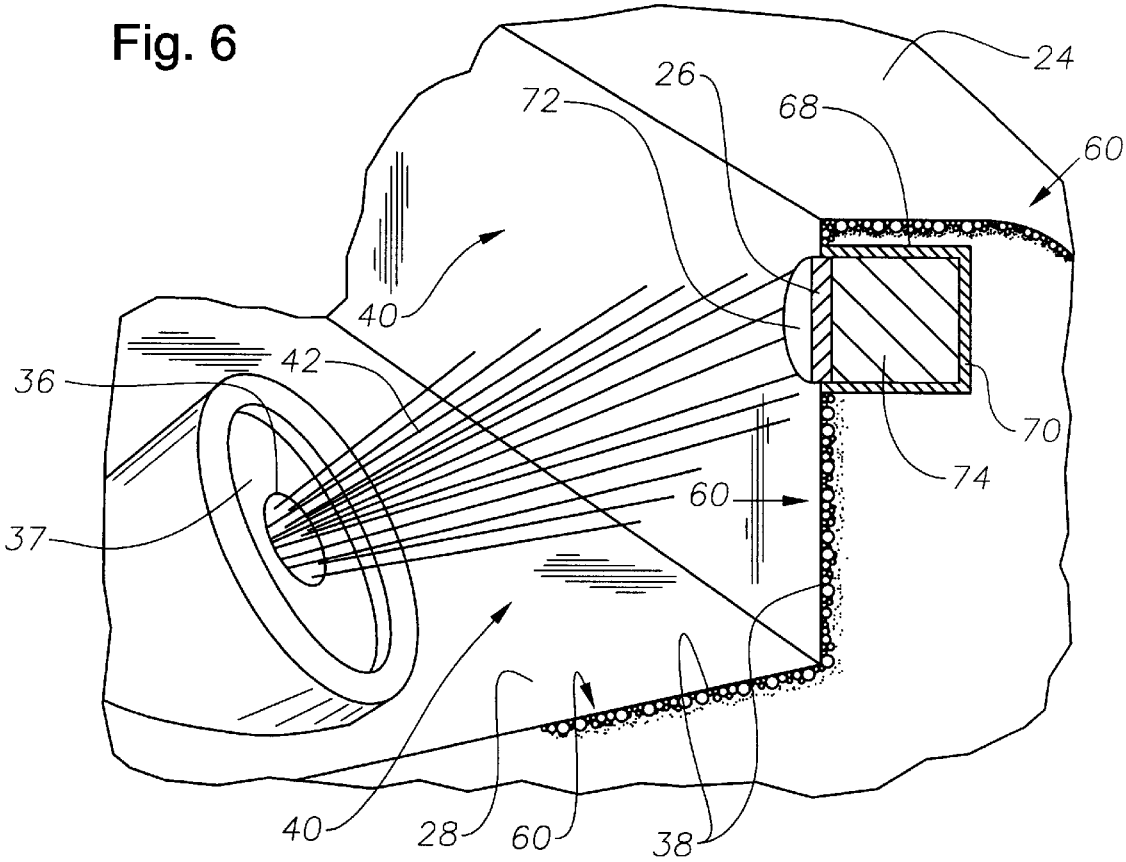
FIG. 6 illustrates a perspective view having a cross-sectional breakout illustrating the thin smooth layer on the cutting face of an earth boring bit of FIG. 1.

Turning now to the drawings, and referring initially to FIGS. 1 and 2, an exemplary fixed cutter drill bit of the present invention is illustrated and generally designated by the reference numeral 10. The drill bit 10 has a bit body 12 that generally includes a lower end 14 having cutting face section 16 and a gauge section 18, and an upper end 20 adapted to be secured to a drill string (not shown) by, for example tapered threads 22. The cutting face section 16 of the bit body 12 includes a number of blades 24 that generally radiate from the central area of the cutting face 16. Advantageously, each of the blades 24 carries a number of cutters 26. Each of the cutters 26 partially protrude from their respective blade 24 and are spaced apart along the blade 24, typically in a given manner to produce a particular type of cutting pattern. Many such patterns exist which may be suitable for use on the drill bit 10 fabricated in accordance with the teachings provided herein. As illustrated in FIG. 6, a cutter 26 typically includes a preform cutting element that is mounted on a carrier in the form of a stud 74 which is secured within a socket 68 in the blade 24. Typically, each preform cutting element is a circular tablet of polycrystalline diamond compact (PDC) or other suitable superhard material bonded to a substrate of a tungsten carbide, so that the rear surface of the tungsten carbide substrate may be brazed into a suitably oriented surface on the stud 74 which may also be formed from tungsten carbide.

While the cutting face section 16 of the drill bit 10 is responsible for cutting the underground formation, the gauge section 18 is generally responsible for stabilizing the drill bit 10 within the bore hole. The gauge section 18 typically includes extensions of the blades 24 which create channels 28 through which drilling fluid may flow upwardly within the bore hole to carry away the cuttings produced by the cutting face section 16. These blade extensions are typically referred to as kickers, which are illustrated by the reference numeral 30. Each kicker 30 generally includes at least one abrading element 32, such as a tungsten carbide insert or surface, which provides a hard, wear-resistant surface to increase the longevity of the kickers 30.

The upper end of the bit body 20 also typically includes breaker slots 34 which are flattened portions of the upper end of the bit body 20 that permit a wrench to be placed on the bit body 10 for installation and removal of the drill bit 10 from a drill string (not shown).

Within the bit body 12 is passaging (not shown) which allows pressurized drilling fluid to be received from the drill string and communicate with one or more orifices 36 located on or adjacent to the cutting face 16. These orifices 36 accelerate the drilling fluid in a predetermined direction. All the surfaces 40 of the bit body 12 are susceptible to erosive and abrasive wear during the drilling process. However, as illustrated in FIG. 6, the high velocity drilling fluid 42 from at least one of these orifices 36 is accelerated directly upon at least one of the cutting elements 26 such that it impinges the cutting element 26 and one of the walls 38 of the channel 28 adjacent to it. Therefore, the surfaces 40 of the walls 38 are particularly susceptible to erosive wear due to the direct impingement of the high velocity drilling fluid 42. The high velocity drilling fluid 42 also cools the cutting element 26 and flows along the channels 28, washing the earth cuttings away from the cutting face. The orifices 36 may be formed directly in the bit body 20, or may be incorporated into a replaceable nozzle 37, as shown in FIG. 6.

The body of the drill bit 10 is formed of high strength material, preferably steel, in a rapid solid state densification powder metallurgy (RSSDPM) process to provide the drill bit 10 with the beneficial attributes of a conventional steel bit. Using the RSSDPM process, a thin hard facing material overlay 60 is integrally formed on portions of the bit body 12. Any of the exposed surfaces 40 on the bit 10 may be integrally formed with the erosion and abrasion resistant overlay 60. However, the overlay 60 is most beneficial on the surfaces 40 of the cutting face 16 adjacent the cutting elements 26 and the walls 38 of the channels 28.

A number of suitable RSSDPM processes are known in the art. For example, a process that uses a pressure transfer media for final densification is described in detail in U.S. Pat. Nos. 4,539,175 and 5,032,352, both of which are incorporated herein by reference for any and all purposes. Another RSSDPM process for fabricating the drill bit 10 is the rapid hot isostatic pressing process described in detail in U.S. Pat. Nos. 4,856,311, 4,942,750, and 5,110,542, all of which are incorporated herein by reference for any and all purposes. In addition, a relatively new RSSDPM process related to the rapid HIP process, known as pneumatic isostatic forging (PIF) is described in detail in U.S. Pat. Nos. 5,561,834 and 5,816,090, both of which are incorporated herein by reference for any and all purposes.

The following process descriptions and the resulting erosion and abrasion resistant layer are also described in the commonly assigned, co-pending U.S. patent application No. 08/950,286 "Rock Bit Hardmetal Overlay and Process of Manufacture".

Figure 3:
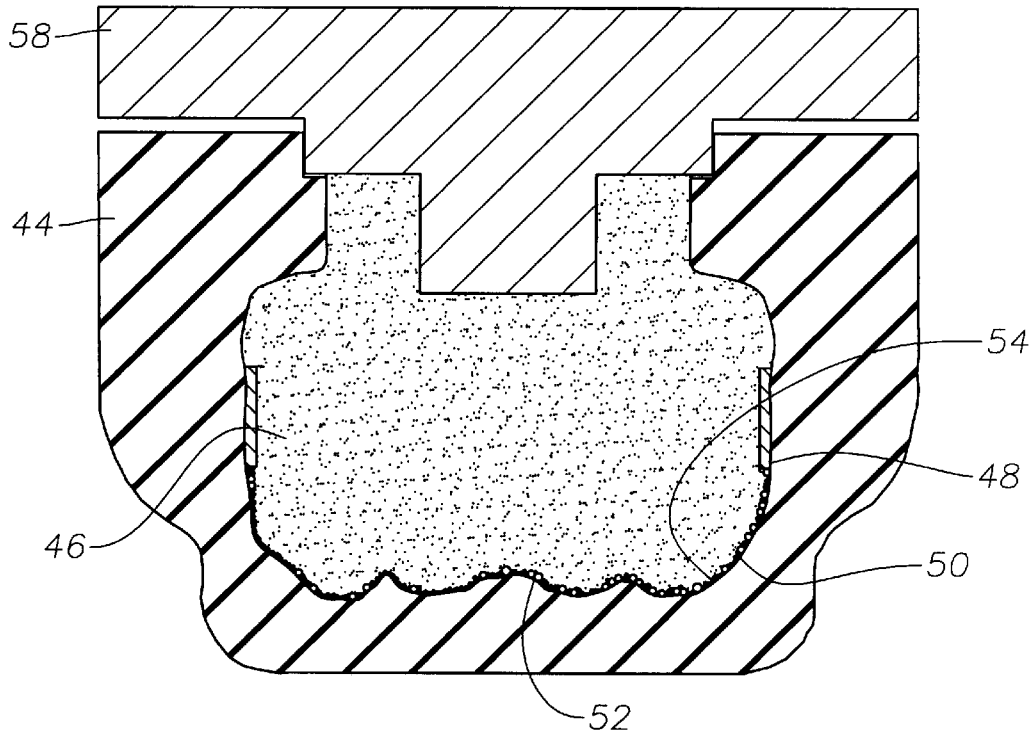
FIG. 3 is a cross section of a flexible mold containing powders and materials to make an earth boring bit of the present invention.

A flexible mold 44 suitable for the RSSDPM process is shown in FIG. 3. FIG. 3 is a cross section view showing such a flexible mold 44 containing powders 46 and materials 48 for a component of an earth boring bit. The interior of the mold 44 shown is in the general form of one of the outer surfaces of the bit body 12 except enlarged and elongated. The mold 44 contains shape of blades 50 and outer surfaces 52 of the body. This is a typical arrangement of a flexible mold 44 used in the rapid solid state densification powder metallurgy process, just prior to the cold densification step of the RSSDPM process. A layer of hard particle particulate 54 is shown on the interior surface of the flexible mold 44. Powders 46 are introduced into the flexible mold 44 along with other materials 48 which may, for example, form the thick hardmetal facing described in U.S. Pat. No. 5,653,299 herein incorporated by reference.

Figure 4:
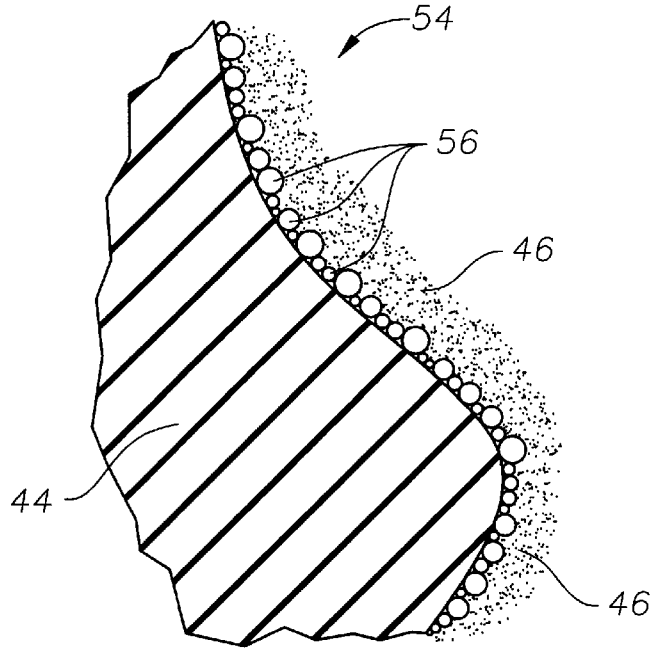
FIG. 4 is an enlarged cross section view of a portion of the hard particle layer as fixed upon the flexible mold materials to make an earth boring bit of the present invention.

FIG. 4 is an enlarged cross section view of a portion of hard particle layer 54 as fixed upon the flexible mold. The layer 54 is comprised of generally spherical particles 56 which may vary in size from about 40 mesh to about 80 mesh. Prior to densification, the layer 54 is generally a single particle in thickness (i.e. a monolayer), although due to the variations in particle size, some overlap of particles is possible. The particles 56 are fixed to the flexible mold 44, preferably with an adhesive (not shown). Other materials (if any) may be introduced into the mold before or after fixing the particles. Once the particles 56 are fixed to the surface of the mold, and the other materials (if any) are introduced into the mold, back fill powders 46 are added. These powders 46 normally contain at least some fine particles which percolate into the interstices between the hard particles 56. A closure 58 (shown in FIG. 3) is added to the mold 44, and the entire assembly is cold densified, preferably in a cold isostatic press (CIP) process, to produce a preform. The preform is then heated and further densified in a rapid high pressure forging process to form a finished component.

Figure 5:
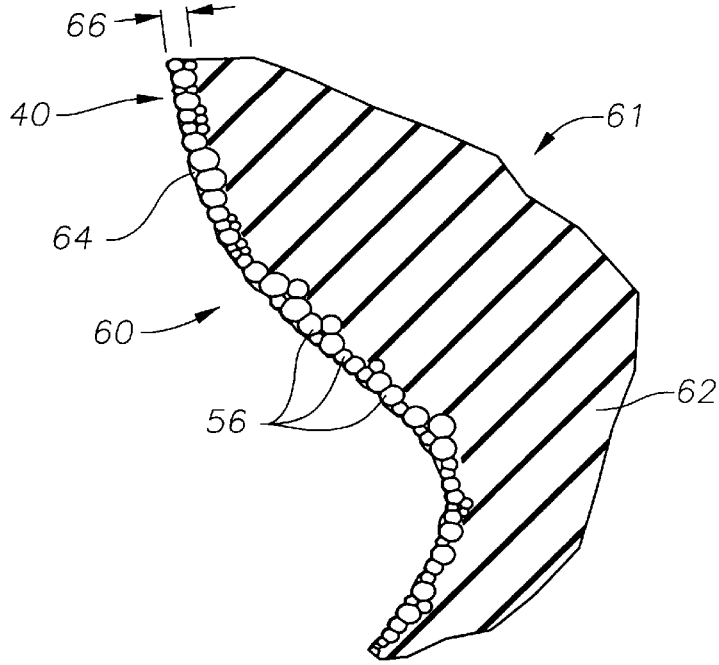
FIG. 5 is an enlarged cross section view of a section of the hard particle layer in a finished article of the present invention.

Shown in FIG. 5 is a cross section view of a portion of the surface 40 of a steel component 61 of an earth boring drill bit 10 of the preferred embodiment. The body portion 62 of the component 61 is formed from the powders 46 earlier introduced in the flexible mold 44. The surface 40 has a thin, erosion and abrasion resistant overlay 60 formed simultaneously with the surface which contains hard particles 56 and a continuous iron alloy matrix 64 between the particles 56. The iron alloy matrix 64 is formed from the powders 46 introduced into the flexible mold 44. The particles 56 and the iron alloy matrix 64 are very similar in structure and function to the matrix material on the surface of infiltrated bits, but without the erosion problems associated with copper based infiltrants.

Although the hard particles 56 are still generally spherical in shape, many are flattened slightly from the forces applied during densification. This deformation tends to further increase the volume density of the overlay 60. Because the hard material particulate 56 also tends to stack during densification, the particles 56 must be between about 40 mesh and about 80 mesh in diameter. This will allow stacking from one, up to about three particles deep (as shown in FIG. 5) and still have relatively smooth surface roughness. The overlay 60 on the surface 40 of the present invention greatly improves the wear, erosion, and abrasion resistance as compared to non-overlaid steel surfaces and readily survives the strains which are applied in operations. The thickness 66 of the overlay 60 varies, but the average thickness of the overlay ranges from about one to about three times the average particle size of the hard material particulate 56.

In one preferred embodiment, a fixed cutter drill bit 10 is produced with hardmetal coverage over the entire cutting face surface 40. The bit body 12 is formed from pre-alloyed steel powder and employs an integral RSSDPM composite hardmetal overlay covering the entire exterior of the cutting face 16. The overlay 60 comprises sintered WC-Co pellets in an alloy steel matrix, and is quite thin, with thickness 66 of about 0.010 inches to about 0.050 inches. The fraction of sintered carbide phase in the overlay is in the range of 75 Volume percent to as much as 95 Volume percent. The binder fraction within the hard phase is in the range of 3 weight percent to 20 weight percent Co. The particle size of the hard phase is preferably between 40 mesh (0.016 inches or 0.42 mm) and 80 mesh (0.007 inches or 0.18 mm). Multimodal size distributions may be employed to maximize final carbide density, but significant amounts of particulate 56 larger than 40 mesh will lead to wrinkling instability during densification, causing detrimental surface roughening on the finished surface 40. Conversely, average particle sizes below 80 mesh exhibit reduced life in severe drilling service, especially at locations of high velocity fluid impingement.

Referring now to FIG. 6, shown is a perspective view of the preferred embodiment shown in a cross-sectional breakout. Illustrated is an orifice 36 formed in a nozzle 37 and a high velocity stream of drilling fluid 42 impinging a cutting element 26 and the surfaces 40 of the walls 38 of a channel 28 on the cutting face 16 of the bit 10. The thin erosion and abrasion resistant overlay 60 covers the surfaces 40 of the walls 38 adjacent to the cutting element 26.

The overlay 60 on the bit 10 of the present invention is uniform in thickness, and is integrally formed with the surface 40 of the cutting face 16. There are no protruding ridges in the overlay 60 to form flow eddies in the wake of the high velocity stream of drilling fluid 42. Flow eddies are known to cause even worse erosive wear on surfaces 40 than direct impingement from the high velocity stream of drilling fluid 42.

In FIG. 6, the overlay 60 is shown formed on the surfaces 40 near orifice 36 and walls 38, up to and fully surrounding a cutter 26. A socket 68, which receives the cutter body, may be machined after densification of the bit body 12 by some combination of electrical discharge machining (EDM), grinding, or boring. The cutter 26 shown in FIG. 6 is a super hard diamond cutting element in the form of a typical composite polycrystalline diamond compact (PDC). The PDC has a diamond cutting surface 72 fused to a substrate and mounted on a solid tungsten carbide stud 74. It is contemplated that other forms of superhard cutting elements such as cubic boron nitride (CBN), diamond like carbon, and other as yet unknown superhard materials could be utilized as cutters 26 within the scope of the present invention The cutter 26 is fixed in the socket 68 with a brazing material 70. In addition to brazing, there are many other ways well known in the art to secure the cutter 26 into the socket 68. to Some of these methods include interference fit, screw threads, use of wedging devices, and many others.

As illustrated in FIG. 6 the fluid orifice 36 may be aimed directly at the front of the blade 24. The surfaces 40 of the blade 24 are integrally formed with the overlay 60 which provide the surfaces with wear and erosion resistance superior to the surfaces of matrix type natural diamond bits. The superiority of the overlaid 60 surfaces 40 of the drill bit 10 allow for the use of aggressive fluid hydraulics where the fluid flow 42 from the orifices 36 may be aimed directly at the blades 24 or along the channels 28 between the blades 24.

The preferred methods of making the above described overlay 60 on a component 62 of an earth boring bit 10 include making the preform and a method for making the component itself. To make the preform, a pattern or other device is used to make a flexible mold 44 with interior dimensions which are scaled up representations of the finished parts. A mixture of hard material particulate 56 is then made by selecting powders with a particle size of between about 40 mesh and about 80 mesh. A layer 54 of this mixture is then fixed to a portion of the flexible mold 44, preferably with a pressure sensitive adhesive applied to the interior surface of the mold 44. Powders 46 and other materials 48 are then introduced into the flexible mold 44. The mold 44 with its contents is then cold isostatically pressed (CIP), thereby compacting the powder and the hard material particulate into a preform. The complete preform is then separated from the flexible mold and later brought to full density in a suitable RSSDPM process.

The structural differences between the drill bit 10 made in a RSSDPM process and a conventional steel or matrix drill bit are significant. A conventional welded hard-faced steel bit demonstrates an abrupt boundary transition between the hard face and the underlying steel as opposed to the continuous iron alloy matrix of the overlay of the present invention. Variations in electrode composition and welders' skill can negatively affect the volume fraction of tungsten carbide particles present in the welded layer. Indeed, the maximum volume fraction of tungsten carbide particles capable of being produced by welding is approximately 50 percent and may be much lower, as opposed to the 75% to 95% volume fractions of the overlay 60 on a bit 10 of the present invention. A welded hardfacing layer is also relatively thick, on the order of from 0.080 inches to 0.25 inches and very rough, as opposed to the thin (0.010 inches to 0.050 inches), smooth overlay 60 of the present invention. The heat generated by applying welded hardfacing can lead to undesirable cracks or warpage of the bit body 12 whereas the cutting face portion 16 of the present invention is made as a unitary body, free of defects.

Unlike a welded or a flame spray process, the integrally formed overlay 60 of the drill bit 10 may be placed in any areas of the bit body where abrasion or erosion resistance is desired. Areas of the drill bit 10 that normally will include the overlaid 60 surfaces 40 are the fronts of each blade 24 that produce and channel the cuttings, as well as the outer surfaces of the blades 24 and of the kickers 30 that contact the bottom or sides of the bore hole. In fact, although FIG. 1 illustrates the gauge region as having hardened abrasion resistant elements 32 in the kickers 30, these elements 32 may be integrally formed within the kicker 30 or the entire outer surface of the kicker 30 may be formed from the other materials 48 previously described.

It should be appreciated that the drill bit 10 having the thin, integrally formed erosion and abrasion surfaces exhibits the advantages of traditional steel bits and traditional matrix bits, without the disadvantages of either. Specifically, because the bit body 12 is made primarily of high strength steel, the drill bit 10 exhibits all the strength of a traditional steel bit, including blade strength, that facilitates a larger blade standoff than is possible with matrix bits. Also, because the overlay 60 is integrally formed of hard particles in a continuous steel matrix, as previously described, the overlaid 60 surfaces 40 are superior to the welded or plasma sprayed surfaces of steel bits, as well as being superior to the alloy infiltrated matrix used in matrix bits. Furthermore, because the drill bit 10 is made by a molding process rather than a machining process, it can be formed into shapes not possible with traditional steel bits.

While the invention may be susceptible to various modifications and alternative forms, specific embodiments have been shown by way of example in the drawings and have been described in detail herein. However, it should be understood that the invention is not intended to be limited to the particular forms disclosed.

For example, the invention as described has been directed primarily to an overlay 60 formed simultaneously with the body 12 of PDC type bits, it is contemplated that many other types of metallic components may be similarly formed within the scope of the present invention. For instance, roller cutter drill bits may have surfaces that may be covered with the overlay 60 for improved erosion resistance, including the surfaces of the cutters. The invention is not limited to any particular method of a rapid solid state densification process nor by any particular shape or configuration of the finished component.

Whereas the present invention has been described in particular relation to the drawings attached hereto, it should be understood that other and further modifications apart from those shown or suggested herein, may be made within the scope and spirit of the present invention. Rather, the invention is to cover all modifications, equivalents, and alternatives falling within the spirit and scope of the invention as defined by the following appended claims.

What is claimed:

1. A fixed cutter earth boring bit comprising a steel bit body with upper and lower ends, the upper end of the bit body adapted to be secured to a drilling string, a cutting face formed on the lower end of the bit body, and passaging within the bit body to receive pressurized drilling fluid from the drilling string, an orifice on the cutting face in fluid communication with the passaging in the bit body to receive the pressurized drilling fluid, the orifice adapted to accelerate the pressurized drilling fluid, at least one superhard cutting element fixed upon the cutting face to engage the earth and effect a drilling action, and, an erosion and abrasion resistant overlay on a portion of the cutting face, the overlay comprising a hard material particulate containing a metal carbide and an alloy steel matrix, wherein the volume fraction of the hard material particulate in said overlay is greater than about 75%, the average particle size of the hard material particulate is between about 40 mesh and about 80 mesh, and the thickness of the overlay is less than about 0.050 inches.

2. The earth boring bit, as set forth in claim 1, wherein the cutting face is forged with rapid solid state densification powder metallurgy processing.

3. The earth boring bit, as set forth in claim 2, wherein the thickness of the overlay is greater than about 0.010 inches and the volume fraction of the hard material particulate in the overlay is less than about 95%.

4. The earth boring bit, as set forth in claim 1, wherein the thickness of the overlay is greater than about 0.010 inches and the volume fraction of the hard material particulate in the overlay is less than about 95%.

5. The earth boring bit, as set forth in claim 1, wherein the average thickness of the overlay is greater than or equal to one, and less than about three, times the average particle size of the hard material particulate.

6. The earth boring bit, as set forth in claim 1, wherein the orifice is formed in a replaceable nozzle.

7. The earth boring bit, as set forth in claim 1, wherein the hard material particulate is substantially spherical.

8. The earth boring bit, as set forth in claim 1, wherein the average thickness of the overlay ranges from about 0.010 inches to about 0.050 inches.

9. The earth boring bit, as set forth in claim 1, wherein the hard material particulate comprises sintered tungsten carbide with a cobalt binder.

10. The earth boring bit, as set forth in claim 1, wherein the hard material particulate comprises sintered tungsten carbide with a cobalt binder, wherein the fraction of said binder is greater than about 3 weight percent of the hard material particulate.

11. The earth boring bit, as set forth in claim 1, wherein the accelerated drilling fluid impinges directly upon the cutting element and the overlay.

12. An earth boring bit comprising at least one fixed cutting element and a surface formed with an erosion and abrasion resistant overlay, the overlay comprising a hard material particulate containing a metal carbide and an alloy steel matrix, wherein the volume fraction of the hard material particulate in the overlay is greater than about 75%, the average particle size of the hard material particulate is between about 40 mesh and about 80 mesh, and the thickness of the overlay is less than about 0.050 inches, wherein a high velocity drilling fluid impinges upon the overlay and the fixed cutting element.

13. The earth boring bit, as set forth in claim 12, wherein the bit comprises a steel bit body with upper and lower ends, the upper end of the bit body adapted to be secured to a drilling string and a cutting face formed on the lower end of the bit body, wherein the fixed cutting element is a superhard material fixed upon the cutting face to engage the earth and effect a drilling action.

14. The earth boring bit, as set forth in claim 13, wherein the bit body is forged with rapid solid state densification powder metallurgy processing.

15. The earth boring bit, as set forth in claim 13, wherein the thickness of the overlay is greater than about 0.010 inches and the volume fraction of the hard material particulate in the overlay is less than about 95%.

16. The earth boring bit, as set forth in claim 13, wherein the average thickness of the overlay is greater than or equal to one, and less than about three, times the average particle size of the hard material particulate.

* * * * *